United States Patent [19]

Maroti

[11] Patent Number: 4,665,730

[45] Date of Patent: May 19, 1987

[54] METHOD OF CONTROLLING PRODUCT TENSION IN A ROLLING MILL

[75] Inventor: Endre S. Maroti, Shrewsbury, Mass.

[73] Assignee: Morgan Construction Company, Worcester, Mass.

[21] Appl. No.: 785,724

[22] Filed: Oct. 9, 1985

[51] Int. Cl.[4] ..... B21B 37/06

[52] U.S. Cl. ..... 72/205; 72/8; 72/14; 72/16; 72/17

[58] Field of Search ..... 72/8–12, 72/14, 16, 17, 19, 234, 205

[56] References Cited

U.S. PATENT DOCUMENTS 3,964,938 6/1976 Tolliver et al. ..... 72/205

4,306,440 12/1981 Demny ..... 72/205

*Primary Examiner*—Robert L. Spruill

*Assistant Examiner*—Steve Katz

*Attorney, Agent, or Firm*—Maurice E. Gauthier

[57] ABSTRACT

In a rolling mill wherein product is rolled continuously in successive first and second blocks at the finishing end of the mill, a pinch roll unit is interposed between the two blocks. The motor speed of the pinch roll unit is employed in combination with other variables to preset the motor speed of the second block prior to entry of the product front end therein. The preset motor speed of the second block produces an acceptable level of interblock product tension once the product has entered the second block. Thereafter, product elongation in the first block is monitored and required adjustments to the motor speed of the second block are made in order to maintain interblock product tension within acceptable limits.

2 Claims, 2 Drawing Figures

METHOD OF CONTROLLING PRODUCT TENSION IN A ROLLING MILL

DESCRIPTION OF THE INVENTION

1. Field of the Invention

This invention relates generally to continuous rolling mills of the type which thermo-mechanically treat products such as steel rods, and is concerned in particular with an improvement in the speed regulation of such mills.

2. Description of the Prior Art

Thermo-mechanical treatment in a rod mill usually entails hot rolling a product through conventional roughing and intermediate stands and then through a first block to produce a semi-finished round. The semi-finished round is then passed through one or more water boxes where it is subjected to an in line water quench to a surface temperature of about 500° C. before being finish rolled in a second block. As herein employed, the term "block" refers to a plurality of mechanically interconnected rolling stands driven by a common drive which usually consists of single or tandem variable speed electric motors.

While the product is being rolled continuously in both the first and second blocks, the tension in that portion of the product passing between the blocks must be carefully controlled. Too little tension may cause the product to buckle and possibly cobble whereas excessive tension will adversely affect tolerances. Ideally, the product will be maintained under slight substantially constant tension as it is being rolled in both blocks. In order to do this, however, the motor speeds of the first and second blocks must be precisely coordinated.

In the past, attempts have been made at maintaining the required level of interblock product tension by monitoring and controlling the motor speeds of the block drives. While such systems are marginally adequate for relatively slow speed rolling operations, they are incapable of operating effectively under high speed rolling conditions, e.g., where the speed of the product passing between the blocks is at or above 50 m/sec.

The major problem with the conventional control systems is that they lack a true speed reference for the product passing from the first block to the second block. Drive motor speeds are not reliable indicators of true product speed because of the forward slip experienced by the product during the rolling operation.

SUMMARY OF THE PRESENT INVENTION

In the method and system of the present invention, a pinch roll unit is interposed between the first and second blocks. As herein employed, the term "pinch roll unit" refers to a driven pair of rolls arranged to grip the product without deforming or reducing the product cross section to any significant degree. There is, accordingly, no appreciable forward slip in the pinch roll nip, which means that the motor speed of the pinch roll drive can be relied upon as an accurate indication of true product speed. According to the present invention, prior to the arrival of the product front end at the second block, the following measurements are taken:

$A_e$=Cross sectional area of product entering first block.

$A_x$=Cross sectional area of product exiting from first block.

$S_1$=Drive motor speed of first block.

$S_3$=Drive motor speed of pinch roll unit.

Based on these measurements, the following calculations are made:

$$e=(A_e)\div(A_x)$$

$$R_v=(S_1)\div(S_3)$$

$$V/t=(A_x)\cdot(S_3)$$

where:

e=total product elongation in the first block.

$R_v$=ratio value of drive motor speeds of first block and pinch roll unit.

V/t =Volume per unit of time of product exiting from first block.

The values of e, $R_v$ and V/t are stored and $S_3$ is employed to preset the drive motor speed $S_2$ of the second block. At this time, the product is in a "zero tension condition" because it has yet to enter into and is thus unaffected by the rolling action of the second block. $S_2$ will be preset to produce a slight interblock tension in the product after it has entered the second block and is being continuously rolled in both blocks. As herein employed, the term "slight tension" means that level of tension which will insure smooth passage of the product between the two blocks without adversely affecting the cross sectional area of the product exiting from the first block.

After entry of the product in the second block, the above listed measurements and calculations are repeated, and the resulting values of e, $R_v$ and V/t are compared with the stored zero tension condition values. If an unacceptable variation in e is detected, and if that variation is attributable to interblock product tension and not to unacceptable variations in either $R_v$ or V/t, then an adjustment is made to $S_2$ to adjust interblock product tension and thereby bring e within acceptable limits.

DETAILED DESCRIPTION OF DISCLOSED EMBODIMENT

Figure 1:
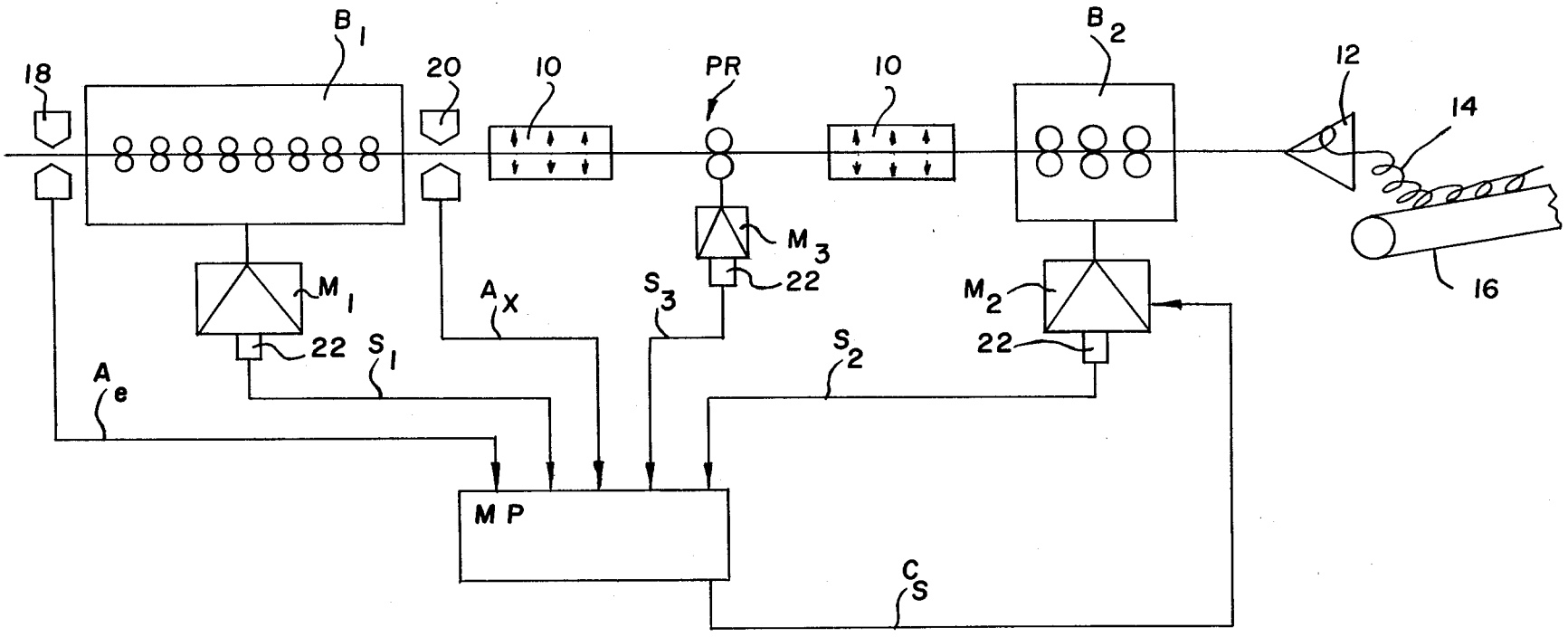
FIG. 1 is a schematic illustration of a rod mill arrangement in accordance with the present invention.

Referring initially to FIG. 1, the finishing end of a steel rod rolling mill is shown as including a first block $B_1$ driven by a first motor means $M_1$. As herein employed, the term "motor means" means variable speed electric motors employed either singly or in tandem combinations. The first block is adapted to roll a round received from a preceding conventional arrangement of roughing and intermediate stands (not shown). The product emerges from the first block in a semi-finished state, and is then directed through one or more water cooling boxes 10 before being rolled to a finished product in a second block $B_2$ driven by a second motor means $M_2$. From here, the finished product is directed to a laying head 12 where it is formed into rings 14. The rings are deposited in an overlapping offset pattern on a conveyor 16, and after undergoing further cooling on the conveyor, are eventually gathered into coils at a reforming station (not shown).

The blocks $B_1$ and $B_2$ can be of any conventional design, such as for example that shown in U. S. Pat. No. Re.28,107. The laying head 12, water boxes 10 and conveyor 16 are also standard pieces of equipment well known to those skilled in the art.

In a typical rolling mill operation producing 5.5 mm. thermomechanically treated steel rod at a delivery speed of about 100 m.sec., the product will enter the first block $B_1$ at a speed of about 11 m/sec., with a temperature of about 850 ° C. and a cross sectional area $A_e$ of about 240 $mm^2$. The product will exit from the first block at a speed of at least about 50 m/sec. and at a temperature of at least about 850° C. with a cross sectional area $A_x$ of about 38 $mm^2$. As the product passes through the water boxes 10, it will be cooled to a reduced temperature of below about 500° C. before entering the second block $B_2$. The rolling action of the second block will produce a finished cross section which ideally will have the desired 5.5 mm. diameter and an area of 23.76 $mm^2$.

In order to insure that the product experiences a smooth transition between the first and second blocks $B_1$, $B_2$, the speed of the second block's motor means $M_2$ is adjusted to produce a slight interblock tension in the product, e.g., approximately 0.2 $Kg/mm^2$. In order to maintain this level of tension, the $M_2$ speed regulation must be extremely precise, preferably to within ±0.1% error max.

In order to achieve this objective, and in accordance with the present invention, a gauge 18 is positioned in advance of the first block $B_1$ to measure the entering product cross sectional area $A_e$ and another gauge 20 is similarly positioned after the first block to measure the exiting product cross sectional area $A_x$. A pinch roll unit PR is located between the two blocks $B_1$ and $B_2$. The pinch roll unit is driven by a third motor means $M_3$. As previously indicated, the pinch roll unit is designed to grip the product without deforming or reducing its cross section to any significant degree.

The operating speeds $S_1$, $S_2$, $S_3$ of the first, second and third motor means $M_1$, $M_2$ and $M_3$ are measured by tachometers 22. The outputs of the tachometers 22 and the gauges 20, 18 are fed to a micro processor MP, and a control signal $C_s$ from the micro processor is used to control the speed of the second motor means $M_2$ driving the second block $B_2$.

Figure 2:
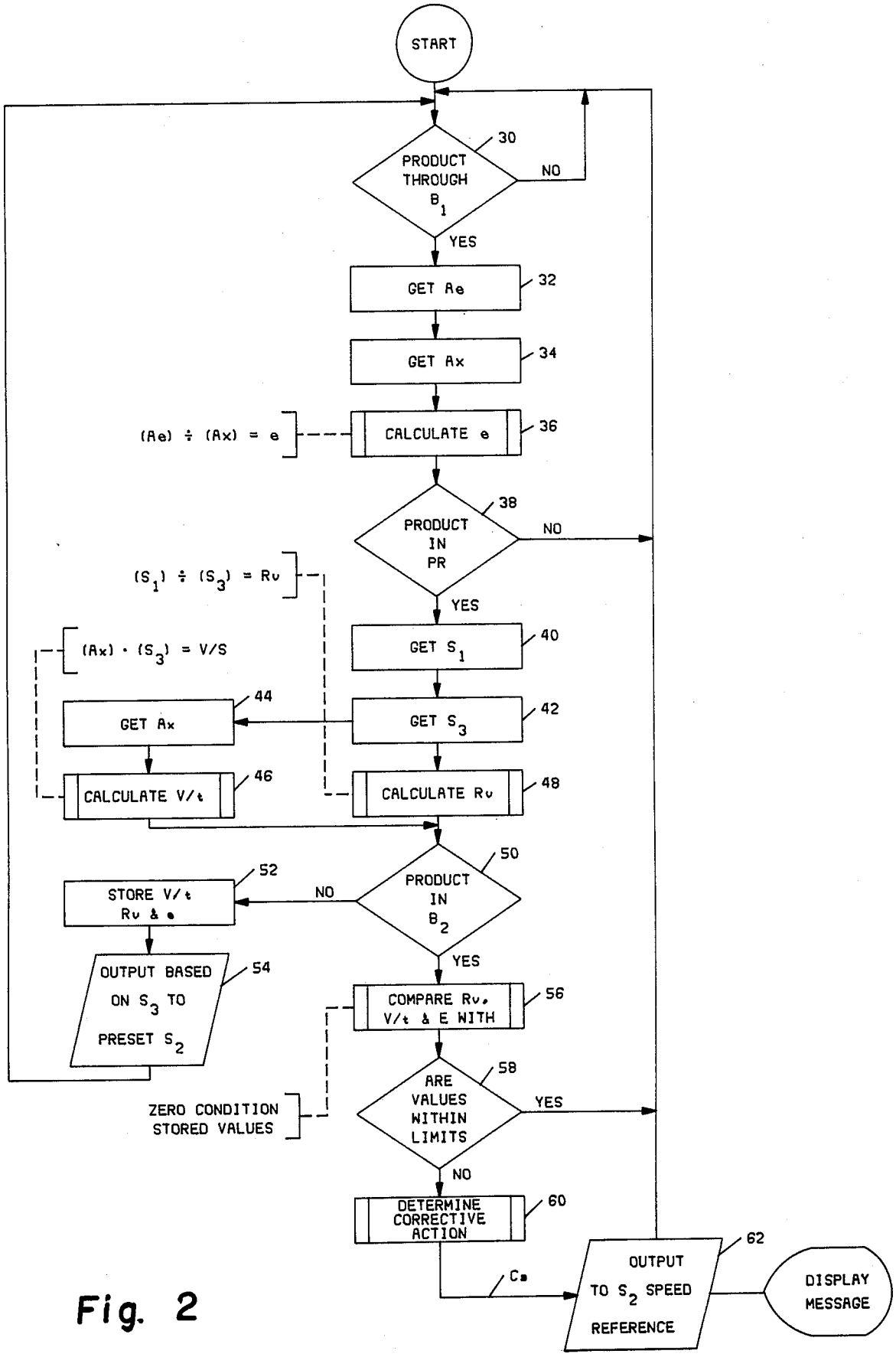
FIG. 2 is a flow chart of a typical embodiment of system software.

With reference now to FIG. 2, which is a control program flow diagram for the system of FIG. 1, beginning at 30 and based on the outputs of gauges 18 and 20, a decision is made as to whether the product has passed through the first block $B_1$. If it has not, the program recycles from START. If it has, then as indicated at 32 and 34, the entry and exit areas $A_e$, $A_x$ are obtained and as indicated at 36, the elongation e in the first block $B_1$ is calculated. Then, as indicted at 38, a decision is made as to whether the product has arrived at the pinch roll unit PR. If it has not, the program recycles from START. If it has, then as indicated at 40, 42 and 44, the motor speeds $S_1$, $S_3$ of the first block $B_1$ and pinch roll unit PR and the exiting area $A_x$ from the first block are measured. As indicated at 46 and 48, these measurements are used to calculate the volume of metal per unit of time V/t exiting from the first block $B_1$ and the ratio value $R_v$ of motor speeds $S_1$ and $S_3$.

Then, as indicated at 50, a decision is made as to whether the product has entered the second block $B_2$. If it has not, then a zero tension condition exists between the two blocks $B_1$ and $B_2$, and as indicated at 52, the values for v/t, $R_v$ and e are stored, and as indicated at 54, an output signal ($C_s$ in FIG. 1) based on the drive motor speed $S_3$ of the pinch roll unit is used to preset the drive motor speed $S_2$ of the second block $B_2$. This preset speed is intended to produce the previously mentioned slight interblock tension of approximately 0.2 Kg/,$^2$. The program then recycles from START.

As indicated at 56, once the product is in the second block $B_2$, the $R_v$, V/t and e calculations are compared with the zero tension condition stored values. As indicated at 58, a decision is then made as to whether the values are within predetermined limits. If they are, the program recycles from START.

However, if this comparison indicates that one or more of the calculated $R_v$, $V_t$ and e values do not compare favorably with the stored zero tension condition values, then as indicated at 60, a determination must be made as to what if any corrective action is required. For example, if the product elongation e in the first block $B_1$ has undergone an unacceptable change, and this change is attributable to interblock tension and not to variations in $R_v$ or $V_t$, then as indicated at 62, the speed $S_2$ of the second block's drive motor $M_2$ is adjusted to correct the level of interblock tension. On the other hand, if the change in elongation is attributable to changes in $R_v$ and/or $V_t$, the speed $S_2$ of drive motor $M_2$ will remain unchanged and appropriate messages will be displayed to operating personnel to indicate that other mill adjustments are required. Such other adjustments might, for example, include roll parting adjustments in the first block $B_1$ or in the intermediate mill.

In light of the foregoing, it will now be appreciated by those skilled in the art that the operating speed $S_3$ of the pinch roll drive motor $M_3$ provides a valuable and heretofore unobtainable insight into the rolling conditions in and between the first and second blocks $B_1$, $B_2$. More particularly, the value of $S_3$, which as previously noted is a reliable indicator of true product speed, is useful to preset the operating speed $S_2$ of the second block's drive motor $M_2$ before the product arrives at the second block. This anticipatory action obviates problems that might otherwise occur if the product front end were to be allowed to enter the second block $B_2$ under conditions where the motor speeds $S_1$, $S_2$ were dangerously mismatched.

The value of $S_3$ also provides a more accurate basis for calculating the volume per unit time $V/_t$ of product exiting from the first block $B_1$. This in turn helps to identify the causes of unacceptable variations in interblock tension other than that that might be due to an improper setting of the second block's drive motor speed.

I claim:

1. In a rod rolling mill wherein steel is hot rolled to a semi-finished product in a first block driven by a first motor means, and the semi-finished product is quenched before being rolled to a finished product in a second block driven by a second motor means, a method of controlling the operating speed of said second motor means in order to maintain an acceptable level of interblock product tension while the product is being continuously rolled in both of said blocks, said method comprising:

(a) rolling the semi-finished product through a pinch roll unit interposed between said first and second blocks, said pinch roll unit being driven by a third motor means;

(b) after the product front end has cleared said pinch roll unit, and while it is in a zero tension condition prior to entering into said second block, measuring at least the following:

$S_1$=operating speed of said first motor means;
$S_2$=operating speed of said second motor means;
$S_3$=operating speed of said third motor means;
$A_e$=entering product cross sectional area at said first block;
$A_x$=exiting product cross sectional area at said block;

(c) comparing $S_2$ and $S_3$, and based on this comparison, making any required adjustment to the operating speed $S_2$ of said second motor means prior to the entry of the product front end into said second block in order to produce an acceptable level of product tension in that section of the product passing between said blocks after the product has entered the second block and is being continuously rolled in both blocks;

(d) based on the measurements of (b), calculating and storing the following values:
$e=(A_e)\div(A_x)$=total elongation in said first block;
$R_v=(S_1)\div(S_3)$=ratio value of drive motor speeds of said first block and said pinch roll unit;
$V_t=(A_x)\cdot(S_3)$=Volume per unit of time of product exiting from said first block;

(e) after entry of the product in said second block, repeating the measurements of (b) and based on said repeated measurements, recalculating the values of (d);

(f) determining if unacceptable variations exist between the recalculated value of e and the previously stored values of e; and (g) if such an unacceptable variation exists and is attributable to an improper level of interblock product tension and not to unacceptable variations in $R_v$ or $V/_t$, adjusting the operating speed $S_2$ of said second motor means to correct the level of interblock product tension and thereby bring the value of e to within acceptable limits with reference to the previously stored value of (e).

2. In a rod rolling mill wherein steel is hot rolled to a semi-finished product in a first block driven by a first motor means before being rolled to a finished product in a second block driven by a second motor means, a method of controlling the operating speed of said second motor means in order to maintain an acceptable level of interblock product tension while the product is being continuously rolled in both of said blocks, said method comprising:

(a) rolling the semi-finished product through a pinch roll unit interposed between said first and second blocks, said pinch roll unit being driven by a third motor means;

(b) after the product front end has cleared said pinch roll unit, and while it is in a zero tension condition prior to entering into said second block, measuring at least the following:
$S_1$=operating speed of said first motor means;
$S_2$=operating speed of said second motor means;
$S_3$=operating speed of said third motor means; and (c) comparing $S_2$ and $S_3$ and based on said comparison, making any required adjustment to the operating speed $S_2$ of said second motor means prior to the entry of the product front end into said second block in order to produce an acceptable level of product tension in that section of the product passing between said blocks after the product has entered said second block and is being continuously rolled in both blocks.

* * * * *